United States Patent [19]

Blomqvist et al.

[11] 4,105,174

[45] Aug. 8, 1978

[54] DEVICE FOR RECEIVING OR TRANSMITTING RADIATION

[75] Inventors: Åke Hugo Petrus Blomqvist; Rolf Lennart Stålfors, both of Karlskoga, Sweden

[73] Assignee: AB Bofors, Bofors, Sweden

[21] Appl. No.: 687,125

[22] Filed: May 17, 1976

Related U.S. Application Data

[63] Continuation of Ser. No. 473,035, May 24, 1974, abandoned.

[30] Foreign Application Priority Data

Jun. 8, 1973 [SE] Sweden ..... 7308109

[51] Int. Cl.[2] ..... F41G 7/14; F41G 7/00

[52] U.S. Cl. ..... 244/3.16

[58] Field of Search ..... 244/3.16

[56] References Cited

U.S. PATENT DOCUMENTS

| | | | |
|---|---|---|---|
| 2,963,973 | 12/1960 | Estey | 244/3.16 |
| 3,434,354 | 3/1969 | Voge | 74/5.12 |

*Primary Examiner*—Samuel W. Engle
*Assistant Examiner*—Thomas H. Webb
*Attorney, Agent, or Firm*—Pollock, Vande Sande & Priddy

[57] ABSTRACT

Apparatus for directing electromagnetic radiation such as a laser beam in a gyro-stabilized direction. The apparatus includes a supporting means on which is fixedly mounted an optical lens having a predetermined focal length and also an element for either detecting the radiation when the apparatus is used to receive the gyro-stabilized beam or for emitting the radiation when the apparatus is used to transmit a gyro-stabilized beam. A mirror is also provided which is mounted on the axis of the lens and, via a cardanic suspension, to the support. The mirror is rotated in its own plane to function as a gyro motor and the beam of radiation is directed so as to impinge upon the reflecting surface of the mirror. Also, the mirror is located at a distance which is one-half the distance of the focal length of the lens from the focal plane of such lens, and the mirror is pivotable about a pivot point on the axis of the lens.

6 Claims, 4 Drawing Figures

DEVICE FOR RECEIVING OR TRANSMITTING RADIATION

This is a continuation of application Ser. No. 473,035, filed May 24, 1974 now abandoned.

BACKGROUND AND OBJECTIONS OF THE INVENTION

The present invention relates to a device suitable for use when receiving or transmitting radiation. The device is particularly suitable when the transmission or receiving direction, respectively, must be gyro-stabilized, so that the aiming direction will be independent of movement of the base. An example of a device which works with received radiation is a homing device in a missile that is guided towards a source of radiation. This can consist of, for example, the heat radiation from the target or of the reflected radiation from a laser designator which illuminates the target. An example of a device where transmitted radiation is stabilized is a gyro-stabilized laser designator mounted on a vehicle where the aiming direction of the beam is to be made independent of the movements of the vehicle. The laser designator can be used, for example, for guiding a missile toward the illuminated target.

Devices for stabilizing the aiming of a transmitted or received beam have usually included a gyro-stabilized platform, the gyros being mounted on the platform which is deflected by servo mechanisms on command from the gyros. A prerequisite for this solution being that the receiving device or the source of radiation is placed on the movable platform, which thereby becomes comparatively heavy and introduces problems with the servo control. Another problem is that with the receiver or source of radiation, respectively, mounted on the movable platform, electrical connections to platform mounted apparatus must therefore be made by means of flexible conductors or by slip-rings.

Attempts have also been made to solve the problem by having the source of radiation on a fixed mounting and using a mirror mounted on the stabilized platform. Such a solution, however, introduces the problem that the beams are deflected by an angle which is twice as great as the angle through which the mirror is turned. Therefore, in this case, the mirror must be aimed one-half of the angle relative to a stabilized platform, and this involves complicated designs.

SUMMARY OF THE INVENTION

According to the invention, apparatus is provided for directing electromagnetic radiation such as a laser beam in a gyro-stabilized direction, the apparatus being capable of either transmitting the radiation or receiving such radiation. The apparatus includes a supporting means, and on this supporting means is mounted a lens which has a predetermined focal length as well as an element which is capable of detecting the radiation when the apparatus is used to receive a gyro-stabilized beam or which is capable of emitting the radiation when the apparatus is used to transmit such a gyro-stabilized beam. A mirror is connected, via a cardanic suspension, to the support, and is located on the axis of the lens. The mirror is rotated in its own plane to function as a gyro motor, and the beam of radiation is directed so as to impinge upon the reflecting surface of the mirror. The mirror is preferably located at a distance which is one-half the distance of the focal length of the lens from the focal plane of such lens, and the mirror is pivotable about a pivot point on the axis of the lens.

BRIEF DESCRIPTION OF THE DRAWINGS

In describing this invention, reference will be made to the accompanying drawings in which.

DETAILED DESCRIPTION OF THE PREFERRED EMBODIMENT

Figure 1:
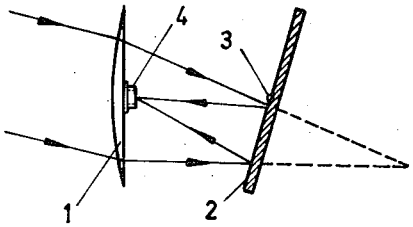
FIG. 1 illustrates diagrammatically an embodiment of the invention including a positive lens and a flat mirror.

FIG. 1 shows, in principle, an embodiment of the invention. A positive lens 1 is provided, and also a flat mirror 2 which can be pivoted about the point 3. A detector 4 is placed adjacent to the lens 1. The distance between the lens 1 and the pivot point 3 of the mirror is equal to one-half of the focal distance of the lens. It will be found that an incident beam which is at right angles to the direction of the mirror will be focused on the detector 4. This relation is applicable exactly for small angles of deflection of the mirror and with good approximation for reasonably large angles. The detector will obscure part of the irradiation, but if the size of the detector is small in relation to the lens, the amount of the radiation that is lost will be insignificant.

In FIG. 1, the lens has been assumed to be a thin lens. If a lens system or a thick lens is used, the detector 4 is to be placed at the rear principal plane of the lens. In most lens system designs, however, this principal plane will be within the lens system, and it may be difficult to place the detector there.

Figure 2:
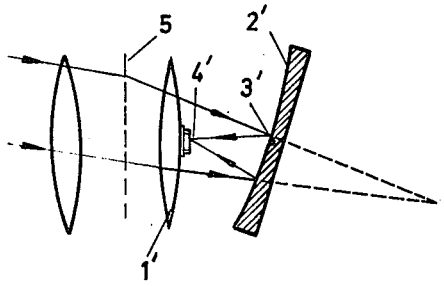
FIG. 2 illustrates diagrammatically an alternative embodiment of the invention employing a concave mirror.

FIG. 2 shows a modification of the invention in which this difficulty has been avoided. In FIG. 2, the lens system has its rear principal plane at 5. In this case, the mirror 2' is concave and is supported at the pivot point 3 which, as in the previous embodiment is at one-half of the focal distance of the lens, measured from the principal plane 5. The incident beams which are parallel to the optical axis of the mirror will then be focused upon the detector 4' which is on the optical axis of the lens system between the lens system 1' and the point 3'.

Figure 3:
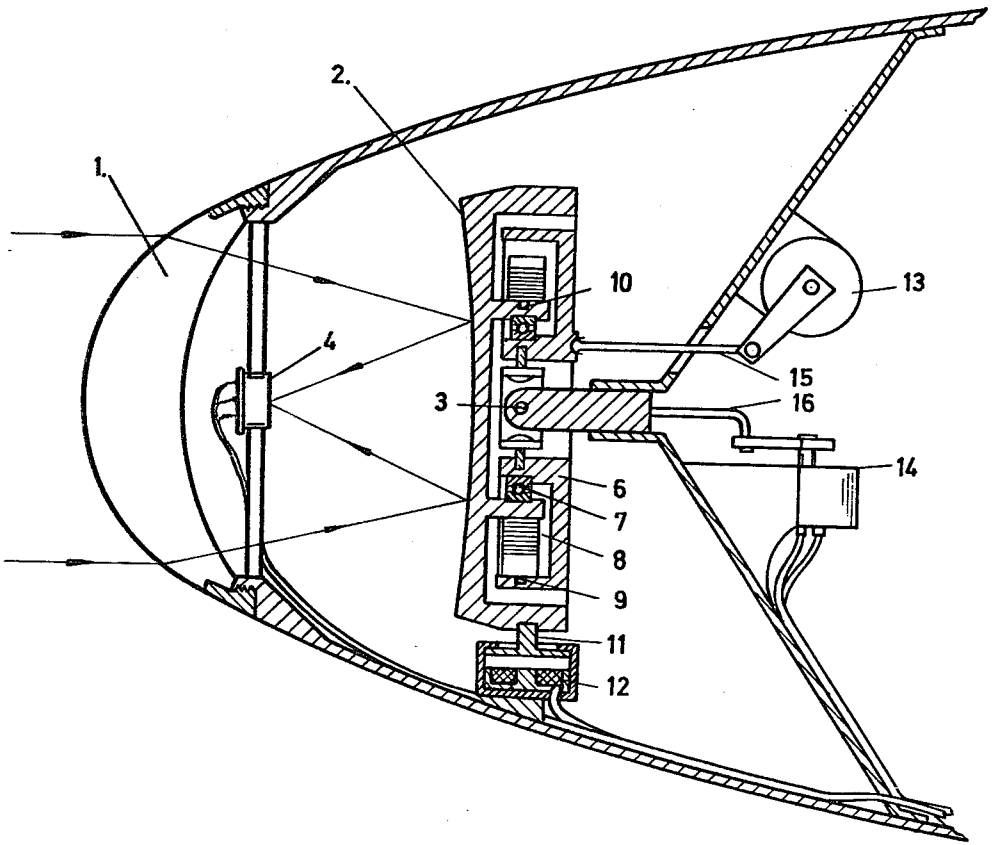
FIG. 3 illustrates apparatus using the inventive concept of the invention in connection with a homing device for a missile having semi-active laser guidance.

FIG. 3 shows a preferable embodiment of a homing device intended for a missile with semi-active laser guidance. When using such a missile, the target is illuminated with a laser beam source arranged for instance according to FIG. 4, and the reflected radiation is received by the homing device in the missile. In this case, the mirror 2 has been given the form of a gyro, by having been provided with a hub 6 with cardanic suspension in the missile. The mirror is supported round the hub with the aid of the bearing 7 and is set in rotation by the spiral spring 8. This is fastened to the periphery of the hub 6 by means of the fastening lug 9. When the spring has been wound up, it engages in the mirror structure by means of the gripping lug 10. A blocking pin 11 counteracts the torque of the spring, and at the same time locks the mirror in a fixed position. At the initiation of the homing device, a current pulse is conducted to the solenoid 12, which then pulls out the blocking pin 11. The spring 8 causes the mirror 2 to rotate. When the spring has run out, the fastening lug 10 disengages from the mirror structure, and the mirror rotates freely. The decrease in speed during the comparatively short time of flight is, in itself, negligible. The fastening lug 10 engages in a point in the mirror structure so that the force component of the spring will lie in the same plane as the suspension point 3. The center of gravity of the composite device in cardanic suspension is also in the suspension point 3. The mirror gyro can then be given a different direction by its being precessed by means of the torque motors 13 and 14 which actuate the hub 6 via push-rods 15 and 16.

Figure 4:
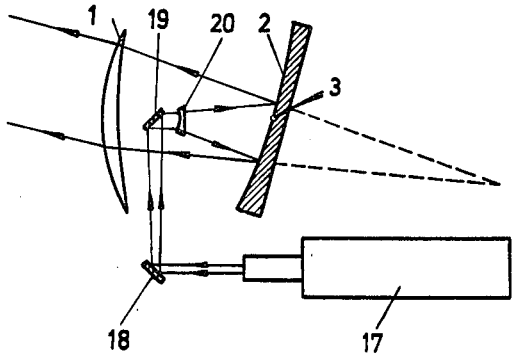
FIG. 4 diagrammatically illustrates apparatus for directing a laser beam in a gyro-stabilized direction toward a target.

FIG. 4 shows, in principle, how a laser designator according to the invention can be arranged. From a laser beam source 17 a narrow beam is conveyed via the flat mirrors 18 and 19 through a small negative lens 20 to the gyro-stabilized mirror 2 where the beam is reflected out through the collimator lens 1. In this case, it is less appropriate to have spring operation of the rotating mirror, as the device is intended for repeated use. Therefore, in this case, an induction motor can be applied in place of the driving spring 8 with the short circuited rotor applied on the mirror structure and the stator winding in the hub 6. The rest of the apparatus including the cardanic suspension, the bearing suspension, and the installation of the torque motor are analogous to the homing device application shown in FIG. 3.

We claim:

1. Apparatus on a moving vehicle for receiving and detecting radiation transmitted from a remote source irrespective of changes in the line-of-sight between the vehicle and the source, a support means fixedly secured to the vehicle, optical lens means having a predetermined focal length and fixedly mounted on said support means, a mirror, means including a cardanic suspension for mounting said mirror on the axis of said lens means to said support means, optical detection means fixedly mounted on said support means and located on the optical axis of said lens means for receiving the radiation reflected thereon by said mirror, means for pivoting said mirror relative to the axis of said lens means about a pivot located on the axis of said lens means at a distance which is one-half the focal length of said lens means from its focal plane, and means for rotating said mirror in its own plane to function as a gyro rotor.

2. The apparatus of claim 1 in which said surface of said mirror upon which said radiation impinges is curved.

3. The apparatus of claim 1 which further includes a hub for rotationally supporting said mirror and means connected between said hub and said mirror for rotating said mirror.

4. The apparatus of claim 3 in which said means connected between said hub and said mirror comprises a spiral spring.

5. The apparatus of claim 4 which further includes a blocking pin operable to a first position in which it blocks rotation of said mirror and to a second position in response to an external signal in which said mirror is freed for rotation.

6. The apparatus of claim 3 which further includes at least one torque motor operating a push rod to move said hub.

* * * * *